United States Patent [19]

Nakamura

[11] Patent Number: 4,681,279

[45] Date of Patent: Jul. 21, 1987

[54] SCREEN ROLL MEANS

[75] Inventor: Daijiro Nakamura, Ono, Japan

[73] Assignee: SM Industrial Co., Ltd, Osaka, Japan

[21] Appl. No.: 862,202

[22] Filed: May 12, 1986

Related U.S. Application Data

[63] Continuation of Ser. No. 740,212, Jun. 3, 1985, abandoned.

[51] Int. Cl.[4] ..... B65H 75/48; E06B 9/20

[52] U.S. Cl. ..... 242/107.3; 242/107.7; 160/294

[58] Field of Search ..... 242/107.7, 107.3, 55, 242/107.6; 160/294, 296, 297, 302, 305, 306, 313

[56] References Cited

U.S. PATENT DOCUMENTS

| | | | |
|---|---|---|---|
| 2,031,459 | 2/1936 | Chambliss | 242/107.7 X |
| 2,557,005 | 6/1951 | McMullen | 242/107.7 X |
| 2,758,527 | 8/1956 | McFadden | 160/294 X |
| 2,815,179 | 12/1957 | Keljik | 242/67.1 R |
| 4,172,563 | 10/1979 | Werner et al. | 242/55 |
| 4,466,475 | 8/1984 | Saito et al. | 160/297 |
| 4,498,517 | 2/1985 | Mase | 160/294 |

*Primary Examiner*—John M. Jillions

*Attorney, Agent, or Firm*—Moonray Kojima

[57] ABSTRACT

An improved take-up mechanism for a roll-up type screen, wherein the screen is pulled out to a desired length, and then by simple pulling and releasing, rolled up on the shaft. The shaft is automatically locked at the desired length of screen by engagement of a lock roller projected by a cam magnet. During pulling out operation, a magnet, a covering yoke and a cylinder disposed therebetween do not move with respect to each other, whereas during roll up operation under force of the wound up spring, the cylinder rotates under control of the magnetic field between the yoke and magnet to control the speed of roll up. The improvement comprises lock rollers on a cam magnet, one way clutches, roll holder, and ring lock for the rollers, together with the magnet to produce the above effects.

1 Claim, 7 Drawing Figures

SCREEN ROLL MEANS

This is a continuation of Ser. No. 740,212, filed June 3, 1985, now abandoned.

BACKGROUND OF THE INVENTION

This invention relates to roll-up type screens, and more particularly, to improvements in the take up mechanism used therein.

In the conventional roll up type screen, the screen is rolled onto a shaft housing a spring which is wound by pulling out the screen and which powers the rolling up of the screen, and uses a locking arrangement which depends on the force of gravity. An operator will pull out the screen and the locking mechanism, which usually has a ratchet and wheel arrangement, will cause the ratchet to lock into the wheel when the operator stops pulling and lets go.

However, disadvantageously, such locking arrangements are deficient in that first to lock, there must be a slight backing up of the roller until the ratchet catches, and second, to unlock, the screen must be pulled slightly and then released.

There is no braking arrangement in the prior art so that depending on the length at which the screen is pulled out, when rolling up different forces will be exerted on the screen, causing possible tearing. Also, at the outermost length, the spring force may be so great that the slight pulling necessary to release the ratchet may cause tearing of the screen. Furthermore, the spring will cause the screen to roll up in a burst of speed if the screen is released by the operator, since no braking arrangement is in the prior screens.

SUMMARY OF THE INVENTION

This invention has a coil spring which is housed inside of a shaft which is adapted to be wound up by pulling out the screen and a carrier means for carrying a satellite differential gear, internal gears communicating with the shaft and a solar gear mounted to drive these gears.

The solar gear is provided with a body and a cam magnet through a one way clutch mechanism which transmits rotation of the shaft when the screen is rolled in one direction. The cam magnet is provided peripherally thereof with a plurality of recessed portions formed at regularly spaced intervals so as to receive rotatable metal lock rollers thereby, and are further provided with roll holders that correspond in number to the lock rollers and held in position opposed thereto so as to enable the rollers to go into and out of in the radial direction. A feed magnet is fixed to the roll holder against the cam magnet with the roll holder being opposite to the inner surface area of the cam magnet. The feed magnet moves the cam magnet together with the roll holder. Solar gear body has a plurality of fins or walls and spaces at the outer periphery with the roll holder having projections in the spaces so that the body can rotate the roll holder by movement of the fins against the projections, and thus permit the lock rollers to either project from the outer periphery of the cam magnet or be received thereinto.

On the outside of the outer periphery of the holder, a lock ring is positioned having a plurality of protrusions on the inner surface thereof to engage the lock rollers. Between the lock ring and a movable portion of the roll shaft there is mounted a unidirectional clutch which is used to transmit to the lock ring the movement of the screen being rolled up.

Toward the inside end of the roll holder is connected a movable shaft through a unidirectional clutch for transmitting rotation of the shaft to a rotor which is positioned between a magnet and a metal yoke, when the screen is rolled up the roll shaft by spring force thereby to provide a braking effect.

Accordingly, an object of the invention is to provide a takeup mechanism in a roll up type shade which is capable of rolling up the shade and locking the shade at a desired position when the shade is pulled out.

Another object is to provide a small dimensioned locking mechanism for the roll up shade.

A still further object is to provide a mechanism for controlling the speed of rolling of the shade, and to prevent sudden large forces from being applied to the shade.

DETAILED DESCRIPTION OF THE PREFERRED EMBODIMENTS

Figure 1:
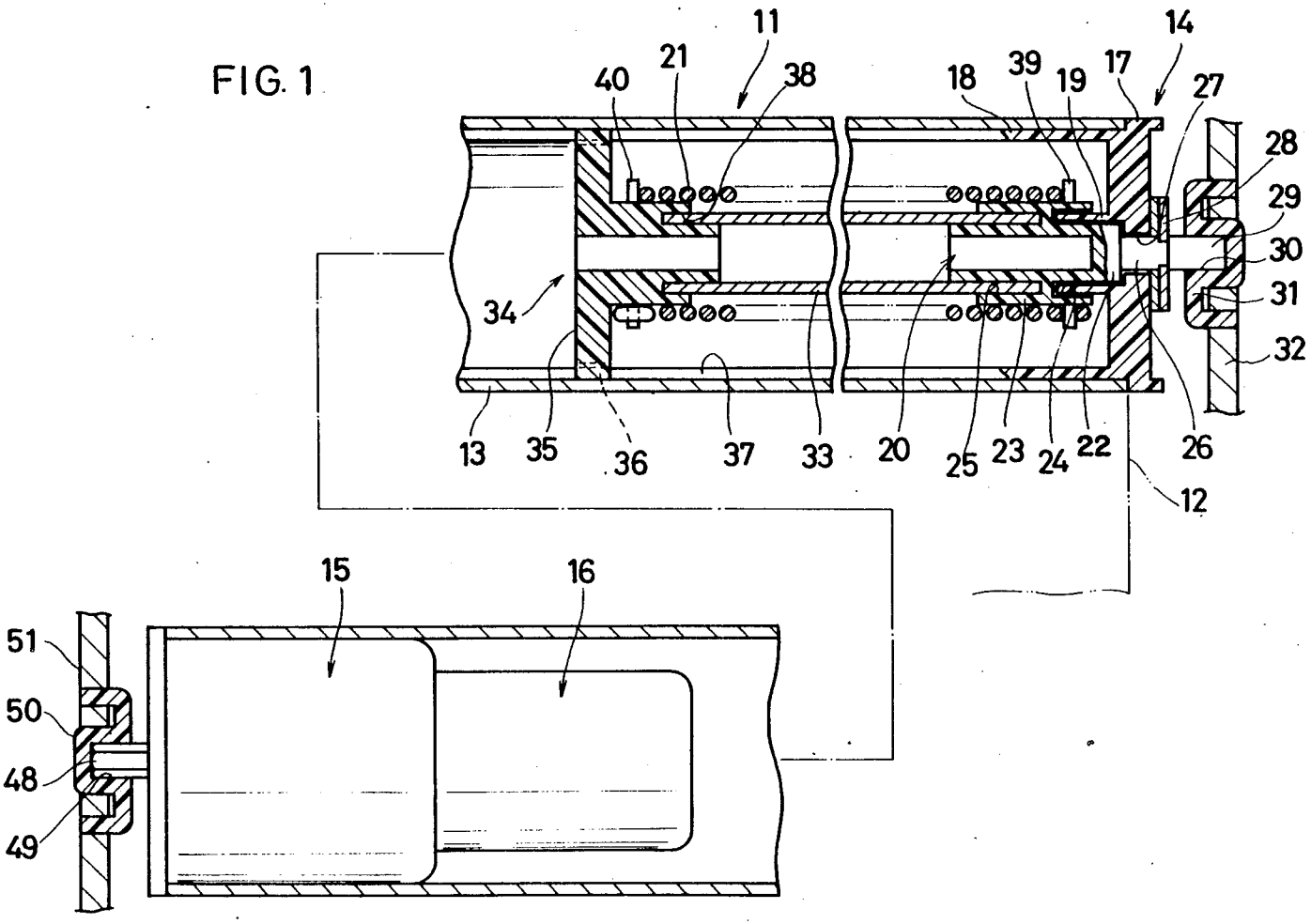
FIG. 1 is a cross sectional view depicting an illustrative embodiment of the invention.

Referring to FIG. 1, a screen roll 11 comprises a screen or shade 12, which has an end portion attached to the outer periphery of a circular cylindrical shaft 13 on which screen 12 may be rolled up or pulled out. In one inner end of shaft 13 is housed a spring mechanism 14 for powering the rolling up or rewinding of screen 12 by a user. In the other end is housed a locking mechanism 15 which holds screen 12 in a pulled out position and also controls the pulling out or rewinding operation; and also a braking mechanism 16 which controllably brakes the rolling of screen 12.

Spring mechanism 14 comprises a cap 17 formed with an outer cylindrical portion 18 and an inner cylindrical portion 19. Portion 18 is pressure fitted into the end of shaft 13.

In inner cylindrical portion 19 is supported an outer end element 20 which holds an end of coil spring 21 (by means of projecting attaching member 39). Outer end supporting element 20 may provide a center shaft 22 which is formed into a cylindrical shape and a coil spring supporting shaft 23 intercommunicated with each other through recessed grooves 24, 25.

Cap 17 has its inner cylindrical portion 19 inserted in recessed portion 24 thereby to support both center shaft 22 and coil spring supporting shaft 23 in movable relation to each other.

The outermost end of shaft 22 is notched to mount movably thereon a small diameter supporting shaft 26 which is inset through a center hole 27 of cap 17. The end is projected outwardly of cap 17 and is rigidly fixed by means of ring 28.

The outermost end of supporting shaft 26 is formed, for example, as seen from an elevational cross section, into a square shaped mounting member 29 which is inserted into a square shaped mounting hole 30 bored into a mounting portion 31 fixed on a fixture member 32. Shaft 26 is screwably fixed in hole 30. The fixture member 32 may be mounted on a wall, window, etc.

Into recessed groove 25 is inserted the outermost end of cylindrical shaft 33 in freely movable relation. Shaft 33 is internally supported by means of an inermost end supporting member 34 which supports the innermost end of coil spring 21 (attached by projecting attaching member 40).

The innermost end supporting member 34 is formed into a recessed groove 38 wherein cylindrical shaft 33 has its innermost end supportably inserted in freely movable relation.

The center part of the outer end supporting member 29 is rigidly fixed so that when the shade 12 is pulled out, the rotation of the shaft 13 is transmitted to the inner end supporting member 34, thereby to drive the member 34 while spring 21 is coiled. When screen 12 is rolled up onto shaft 13, an operator may release the screen 12 to permit the screen to rewind onto shaft 13 by the force of the resilience of spring 21.

Figure 2:
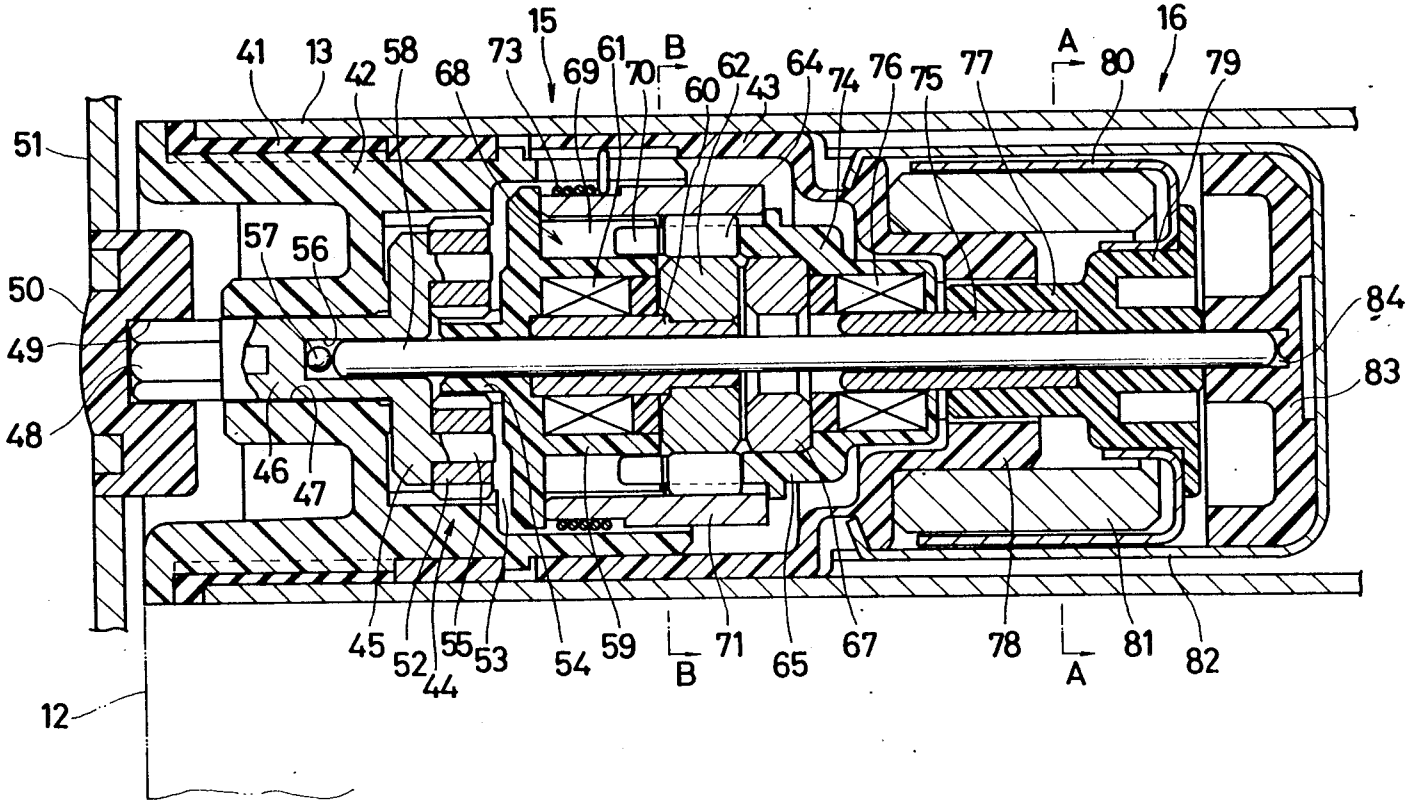
FIG. 2 is a cross sectional view depicting a locking mechanism and a braking mechanism.
Figure 3:
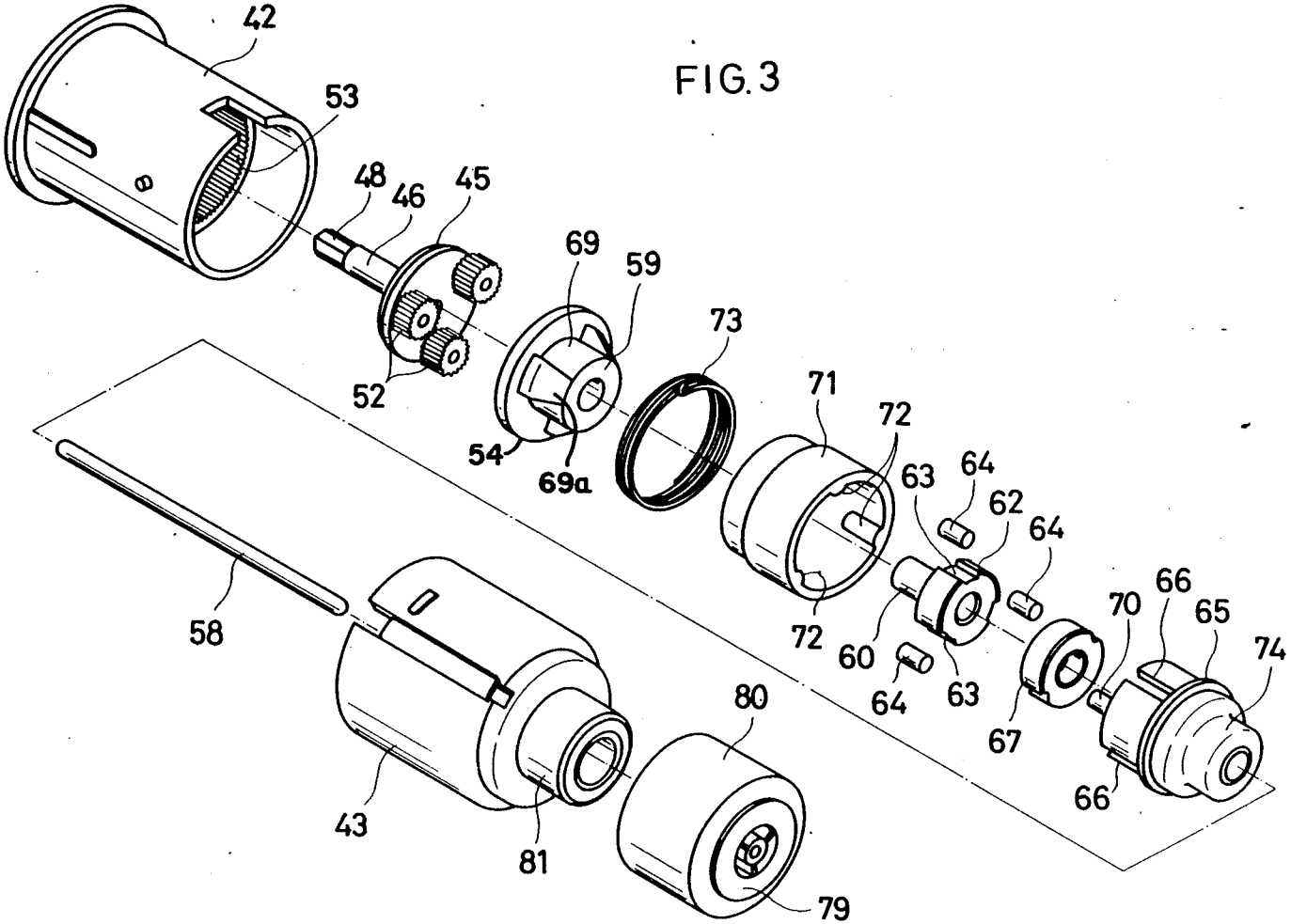
FIG. 3 is a cutaway perspective view of the locking and braking mechanism of FIG. 2.

Turning to FIGS. 2, 3, the outer end of shaft 13 has an inner portion fitted with a cylindrical gear case 42 having thereon a bushing 41 comprising a rubber material. Thus, case 42 moves together with shaft 13 during roll up and pulling out operations. In the inner end of gear case 42 is mounted a housing 43 in a manner such that bushing 41, gear case 42, and housing 43 are movable in integral relation to each other and with shaft 13 during roll up and pulling out operations. In the outermost end of gear case 42 there is formed a satellite or planetary type gear mechanism 44, a carrier 45 which has its shaft portion 46 supported in a center hole 47 bored at the center of gear case 42 by means of a bearing in mutually movable relation. The outermost end of shaft portion 46 is formed in a fixture member 48 which is hexagonal, for example, in shape and is fixedly inserted into a mounting hole 49 bored also in a hexagonal shape on a mounting member 50 rigidly fixed to a fixture member 51. Member 51 is attached to a wall, window, etc.

The satellite differential gear mechanism 44 comprises carrier 45, a plurality of planetary gears 52, an internal gear 53 formed on the inner peripheral surface of gear case 43, and a solar gear 54. Planetary gears 52 are supported on shafts 55 connected to carrier 45. Internal gear 53 has teeth formed on the inner circumferential surface of case 42. In one example, there are three planetary gears 52 and one solar gear 54. Solar gear 54 has a center hole through which shaft 58 is movably inserted with one end inserted into a supporting hole 56 bored axially of carrier 45 with a ball bearing 57 thereat. The solar gear 54 is aligned between the planetary gears 52 with the planetary gears being aligned with the teeth of internal gear 53.

In the innermost end of gear 54 there is connected a cylindrical portion 59 wherein a cam shaft 60 disposed onto shaft 58, is inserted. Between cam shaft 60 and cylindrical portion 59 is mounted a one way clutch 61 which is adapted to transmit one way rotation of gear 54 to cam shaft 60. One way clutch 61 may be any well known type roll clutch, for example.

In the inner end of cam shaft 60 is rigidly fixed a discoidal cam magnet 62 which is disposed in opposition to the inner end of portion 59 and comprises a permanent magnet with three areas equally divided on the outer periphery so as to form recessed portions or grooves 63 for receiving lock rollers 64, which are of magnetizable material such as iron. The rollers being magnetizable would be attracted to the magnet 62 and not fall out of the grooves of the roll holder.

Peripherally surrounding magnet 62 and opposite thereto is rotatably mounted a roll holder 65 which is provided with a number of receiving grooves or slots 66 corresponding in number to the number of lock rollers and grooves 63 on magnet 62 and located to correspond to the location of the grooves 63 on magnet 62. The roll holder 65 also has projections 70, being for example three in number, extending from the holder into the spaces between a plurality of enlarged parts or fins of portion 59.

Figure 4:
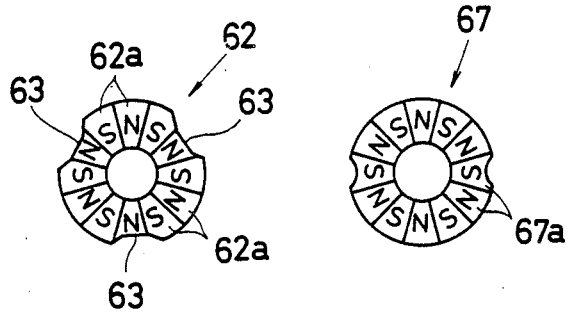
FIGS. 4(A) and 4(B) are explanatory views of a cam magnet and a feed magnet.

A feed magnet 67 which is a permanent magnet, is fixed within holder 65 and positioned to be opposite to the inner surface area of magnet 62. As shown in FIG. 4, feed magnet 67 and magnet 62 have equally divided magnet portions **62*a* and 67*a* and are attracted to each other when their different magnetic poles coincide in positions, and thus, feed magnet 67 would move the cam magnet 62, subject to the one way restraint imposed by one way magnet 61 on shaft 60 connected to magnet 62. Feed magnet 67 being attached to roll holder 65 will attract and move cam magnet 62 in the same direction of movement. Cam magnet 62 fixed to shaft 60 which is within one way clutch 61 is freely movable in one direction and is moved by force of magnet 67 in the one direction. Thus, as the cam magnet is moved for each, for example, 30°, of the grooved parts 63 of cam 62 and the rollers 64 in holder slots 66 will move into or out of the grooves 63. For example, because of the one way clutch, when case 42 is turned in one direction, the cam will move about 60° (about 1/6 of the circle because of the arrangement of the spaces 69 between the fins 69 of portion 59). Then, when the case moves in the opposite direction, feed magnet 67 will move the cam another 60° in the same direction. Because of fins 69*a* on portion 59, the projections 70 will limit the amount of movement of holder 65 and portion 59** during the locking and unlocking.

The cylindrical portion 59, attached to solar gear 54, comprises a plurality, for example 3, recessed grooves 69 formed between a plurality of enlarged parts or fins **69*a* (see FIG. 3) which may be 3 in number and with the spacing such that the enlarged fins 69*a* have about the same number of degrees as the grooves 63 of magnet 62 and the open spaces 69 have about the same number of degrees as the non-grooved parts of cam magnet 62. The roll holder 65 has projections, for example 3 in number, 70 which are disposed in the open spaces 69 and are freely movable therein between the enlarged parts or fins 69*a*** which form stops therefor.

Between the outer periphery surface area of roll holder 65 and inner end of gear case 42, there is inserted a metallic lock ring 71 comprising three protrusions 72 disposed on the inside surface thereof and equally spaced apart from each other so that lock rollers 64 are held in engagement against the protrusions 72 in the locked position when rollers 64 are not in the grooves of cam magnet 62. The rollers 64 are always held by magnetic force within the slots 66 of holder 65 and caused to be extended outside the outer circumference of holder 65 in the locked position, or inside the outer circumference of holder 65 in the unlocked position. That is the rollers move within slots 66 radially inward and outward depending on the locking position. This occurs when cam magnet 62 is moved so that the rollers 64 are in the grooves 63 of cam 62 during the non-locked position, and outside of the grooves 63 of cam 62 during the locked position. When rollers are outside of grooves 63 and outside the outer circumference of the holder 65, the rollers will contact protrusions 72 of lock ring 71. On the other hand when rollers 64 are within grooves 63 and inside the outer circumference or with only a small part of the roller surface outside the outer circumference of holder 65, the rollers will be out of contact with protrusions 72 of lock ring 71.

Between the outer periphery of lock ring 71 and gear case 42 and on ring 71 is mounted a one way clutch 73 for transmitting to lock ring 71 through case 42 the one way rotation of shaft 13 (which rotates in the direction of screen 12). One way clutch 73 comprises a well known type spring clutch. Thus, when the rollers 64 are locked against protrusions 72 of ring 71, the one way clutch 73 stops rotation of case 42 and portion 59 in one direction of case 42. But, even when locked, in the other direction case 42 and portion 59 will rotate. When the rollers 64 are not against protrusions 72 (i.e. in an unlocked state) then case 42 and portion 59 can rotate in both directions.

Advantageously, the cam magnet is magnetic and the rollers are of metallic material and hence rollers 64 would tend to be attracted and held by cam 62.

The locking and unlocking states are accomplished as follows. In the unlocked state, rollers 64 are held within grooves 66 of holder 65 and within grooves 63 of cam 62. That is the rollers are within the outer periphery of holder 65 or with the roller surface slightly above the periphery. In the locked state rollers 64 are held within grooves 66 of holder 65 and outside of grooves 63 with the rollers 64 being outside of the outer periphery of holder 65 so that rollers 64 will be stopped by protrusions 72 of lock ring 71.

The mechanism involved in going from one state to another is as follows. Gear 54 moves portion 59 which has a one way clutch 61 therein and shaft 60 attached to cam 62. Thus, in the unlocked condition, portion 59 and cam 62 and holder 65 which has a projection 70 in space 69 abutting fin 69*a*, can rotate in the same direction. In the locked condition, the cam 62 can only travel in one direction due to one way clutch 61.

When it is desired to obtain a locked condition after rolling up, the screen is pulled slightly and then let go. This causes gear 54 and portion 59 to turn about 60°, and projection 70 will move from against one fin 69*a* to another fin 69*a*, and feed magnet 67 will cause cam 62 to move 30°, and cause roller 64 to go from groove 63 to an enlarged part of cam 62 and stick out of slot 66 into a larger radius position against protrusion 72 of ring 71.

When it is desired to obtain an unlocked position and pulling out of the screen, and cause spring 21 to wind up, the screen is pulled out slightly about 60°, released and the pulled. The projection will travel from one fin 69*a* to another portion 59 and move feed magnet which will turn cam 62 30° and move the roller 64 from the larger radius position abutting protrusion 72 to fit in the groove 63 of cam 62 and substantially inside the outer circumference of holder 65. Then, the operator pulls the screen down and winds up spring 21.

When the shade is thus pulled out to a desired length and it is desired to lock the shade at that position, the shade is released slightly and then pulled again. What this does is cause gear 54 and portion 59 to move one way then the other. Projection 70 moves from one fin 69*a* to another 69*a*, and feed magnet 67 moves cam 62 one way again 30° and causes roller 64 to go out into slot 66 and outside of outer periphery of holder 65 against protrusion 72.

Thus, the locking mechanism operates as follows. Cam 62 is allowed to turn in only one direction. It is moved by feed magnet 67 when holder 65 is moved by roller 64 being locked against protrusion 72 and in one direction due to one way clutch 73, that is relative to portion 59. Each time the portion 59 and holder 65 are rotated with respect to each other, the cam 62 is turned in one direction relative to holder 65 and the rollers 64 are moved into and out of the grooves 63 of cam 62 so that the rollers 64 will be in a locked (out of groove 63) or unlocked (inside groove 63) position. This happens each time the projection 70 abuts fin 69*a* on one side. That is projection 70 fits in space 69 (see FIG. 3) and travels from a left side of one fin 69*a* to the right side of a next adjacent fin 69*a*. Each time projection 70 goes back to the left side of the one fin 69*a*, that is left side of one, right side of the next, and then left side of the same one fin, the rollers 64 are moved in or out of grooves 63 of cam 62, and the unlocked or locked positions are engaged.

Braking mechanism 16 comprises an inner shaft end 74 of roll holder 65 wherein there is inserted a rotary shaft 75. Within shaft 75 is rotatably inserted supporting shaft 58, as shown in FIGS. 2 and 3. Between rotary shaft 75 and roll holder 65 is mounted a one way clutch 76 for transmitting one way rotation of shaft 13. The clutch 76 may be a well known type roll clutch.

To the inner (right in FIG. 2) end of rotary shaft 75 is fixed a bushing 77 having a part thereof disposed within a small diameter portion 78 of housing 43. Bushing 77 has an extended extremity 79 formed larger in diameter than portion 78. On the outer periphery of bushing 77 is fixed a cylindrical rotor 80.

Between small diameter portion 78 and rotor 80, a cylindrical magnet 81 is mounted which is press fit onto portion 78. Magnet 78 comprises a permanent magnet and has a slight clearance provided between the outer periphery of magnet 81 and the inner periphery of rotor 80. On the outer periphery of rotor 80 is disposed a cylindrical yoke, which is made of iron, and formed with a small clearance between the periphery of the rotor and yoke. Yoke 82 has its outer end rigidly fixed to housing 43 and its inner end rigidly fixed to shaft supporting member 83. Shaft 58 has its inner end supportably inserted into a hole 84 which is bored at the center of shaft supporting member 83, as shown in FIG. 2.

Figure 5:
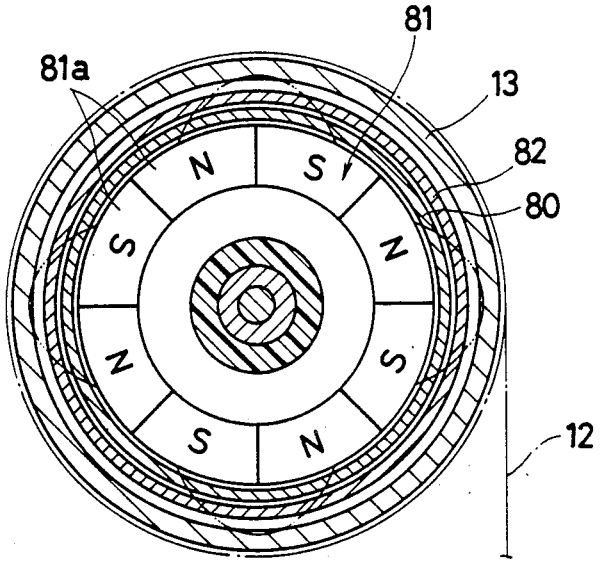
FIG. 5 is a cross sectional view of an elemental magnet part of a braking mechanism, which performs the braking function.
Figure 6:
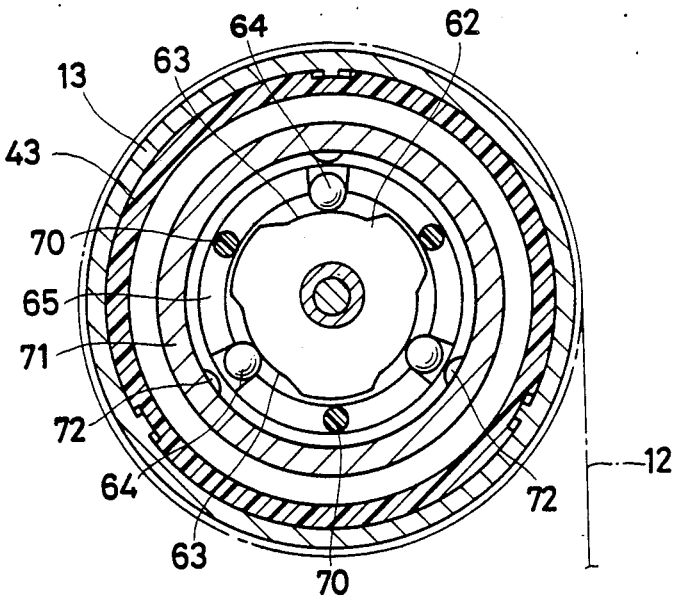
FIG. 6 is a cross sectional view of a locking mechanism which is in an unlocked condition.
Figure 7:
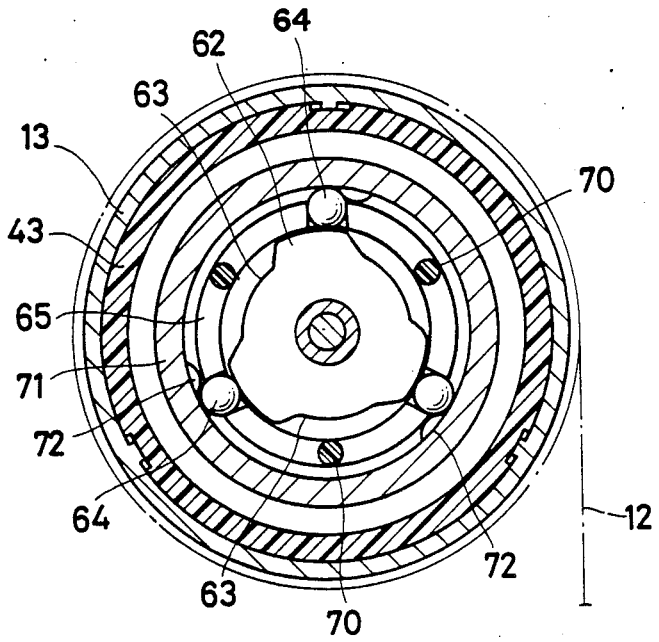
FIG. 7 is a cross sectional view of the locking mechanism which is in a locked condition.

In FIG. 5, cylindrical magnet 81 comprises 8 permanent magnets 81*a* which are equally divided and positioned to have adjoining parts of opposite polarity, so that the magnetic field of the cylindrical magnet 81 reaches yoke 82 circumferentially thereof. Thus, rotor 80 which is made of aluminum, for example, rotates relatively against the magnetic forces between magnet 81 and yoke 82, and then only in one direction, that direction being when shaft 13 is under the resilience force of the spring 21. The aluminum rotor is not highly magnetizable, as for example, would be steel; nor is alumnnum completely non-magnetizable as would be plastic. Thus, within the magnetic field between magnet 81 and yoke 82, rotor 80 is controllably movable powered by resilient force of spring 21 against the magnetic field. Because of one way clutch 76, rotor 80 is moved in only one direction. But, rotor 80 is within the magnetic field between magnet 81 and iron yoke 82, and thus is subject to and is driven by spring 21 against the force of the magnetic field substantially slowed thereby, cause braking of the screen being wound up by force of spring 21.

The foregoing is illustrative of the principles of the invention. Numerous modifications and extensions thereof would be apparent to the worker skilled in the art. All such modifications and extensions are to be considered to be within the spirit and scope of the invention.

What is claimed is:

1. A roll up screen device, comprising a circular cylindrical hollow shaft (13);

a screen (12) which is wound up on the outer periphery of said shaft (13) to a desired length and locked thereat in one condition and rolled out to a desired length and locked thereat in another condition;

spring means (21) disposed in the hollow of said shaft (13) toward one end thereof and wound up by said screen being rolled out to provide resilient force for winding up said screen on said shaft; and contained within hollow of said shaft (13) toward another end thereof, in combination, a gear case (42) tightly fit within said shaft (13) and having gear teeth (53) within the inner peripheral surface thereof;

a housing (43) connected to said gear case (42) and integrally movable therewith;

a gear carrier (45) comprising a shaft (48) for attachment to an external fixture (51) and three planetary gear shafts (55);

three planetary gears (52) rotatably held on said planetary gear shafts (55) and aligned with the gear teeth within said gear case (42), a solar gear (54) disposed aligned within and between said three planetary gears (52) and connected to a cylindrical portion (59), said cylindrical portion (59) comprising a circular cylinder of selected radius and three fins (69*a*) of larger radius extending radially outwardly from said circular cylinder with three spaces (69) between the fins having the selected radius;

a first one way clutch (61) disposed within said circular cylinder of said cylindrical portion;

a magnetic cam (62) having three grooves (63) spaced equally apart around the periphery thereof;

a first shaft (60) attached to said cam (62) and disposed within said first one way clutch for one way rotation of said cam;

three magnetizable rollers (64) disposed about the outer periphery of said cam (62);

a roll holder (65) comprising a cylindrical ring with three grooves (66) therein spaced apart at the same circumferential locations as the grooves in the cam (62), said rollers (64) being held within said grooves (66) of the holder (65), three projections (70) extending from said cylindrical ring and into said three spaces (69) between said fins (69*a*) of the cylindrical portion (59) for movement in the spaces between the fins;

a feed magnet (67) connected to said roll holder and positioned adjacent said cam (62) to cause movement of said cam in a one way direction of said first one way clutch;

a second one way clutch (76) connected to said roll holder and movable therewith;

a lock ring 71 having a third one way clutch 73 thereon and disposed between said case (42) and said roll holder (65), said lock ring having on its inner peripheral surface three protrusions (72), whereby in an unlocked state said rollers (64) are in said grooves (66) of said holder (65) and in said grooves of said cam (62) and said rollers are not in contact with said protrusions (72), and in a locked state said rollers (64) are in said grooves (66) of said holder and outside of said grooves (63) of said cam (62) and in contact with said protrusions (72), and whereby said third one way clutch (73) enables one way rotation of the case (42) in a locked state and two way rotation of said case (42) in an unlocked state;

a cylindrical third magnet (81) connected to said housing (43);

a cylindrical magnetizable yoke (82) surrounding said third magnet (81) and connected to said housing (43) and movable therewith;

a cylindrical aluminum rotor (80) disposed between said third magnet (81) and said yoke (82); and a shaft (75) connected to said rotor (80) and disposed in said second one way clutch (76) to enable said rotor (82) and shaft to move in only one direction, whereby during pulling out operation when said spring is being wound up said third one way clutch (76) prevents said rotor (80) from moving relative to said third magnet (81) and said yoke (82), and during rolling up operation driven by said spring (21) said rotor rotates by force of said spring (21) against the effects of the magnetic field between said third magnet (81) and said magnetizable yoke (82) to cause braking of movement of said holder (65) in relation to said shaft (13); and wherein movement of shaft (13) in the unwinding direction and then in the winding direction, which causes each projection (70) to travel from a left side of one fin (69*a*) to the ring side of an adjacent fin (69*a*), moves said cam (62) so that rollers (64) come outside grooves (63) to contact the protrusions (72) to lock the shaft (13) against winding rotation.

* * * * *